United States Patent [19]

Ito et al.

[11] 4,417,350

[45] Nov. 22, 1983

[54] COUNTER CONTROL IN ELECTROPHOTOGRAPHIC COPIER

[75] Inventors: Hideo Ito; Masazumi Ito, both of Toyokawa; Kenzo Nagata, Okazaki; Yutaka Irie, Toyokawa, all of Japan

[73] Assignee: Minolta Camera Kabushiki Kaisha, Osaka, Japan

[21] Appl. No.: 246,318

[22] Filed: Mar. 23, 1981

[30] Foreign Application Priority Data

Mar. 28, 1980 [JP] Japan ..... 55-40982

[51] Int. Cl.[3] ..... G06M 3/06

[52] U.S. Cl. ..... 377/8; 355/14 CU

[58] Field of Search ..... 235/92 SB, 92 DE, 92 PE, 235/92 CA, 92 R; 364/525; 355/14 CU, 14 SH, 14 R, 3 SH; 271/9; 377/6, 8, 16, 39, 55

[56] References Cited

U.S. PATENT DOCUMENTS

| | | | |
|---|---|---|---|
| 3,682,544 | 8/1972 | Glaser | 235/92 SB |
| 4,058,815 | 11/1977 | Warner et al. | 355/14 CU |
| 4,105,914 | 8/1978 | Murata et al. | 355/14 CU |
| 4,128,756 | 12/1978 | Nagano et al. | 355/14 CU |
| 4,253,760 | 3/1981 | Tsuda et al. | 355/14 CU |
| 4,314,147 | 2/1982 | Miyagawa et al. | 235/92 SB |

*Primary Examiner*—Gary Chin

*Attorney, Agent, or Firm*—Wenderoth, Lind & Ponack

[57] ABSTRACT

A counter control device for an electrophotographic copying machine of a type having a preset counter device is selectively operable in one of a multi-copy mode wherein a copying operation is repeated to produce a plurality of copies while copying papers which are to have an image affixed thereto are automatically fed one at a time and a manual feed mode wherein the copying operation is carried out by the use of copying papers which are to have an image affixed thereto and which are fed manually one at a time. The counter control device includes a counter for counting the number of copies being made or left unfinished each time one cycle of the copying operation is completed. The counted value is displayed by a display unit which is also operable even when the machine is set to operate in the multi-copy mode.

12 Claims, 5 Drawing Figures

COUNTER CONTROL IN ELECTROPHOTOGRAPHIC COPIER

BACKGROUND OF THE INVENTION

The present invention relates generally to an electrophotographic copying machine of a type having a multi-copy mode in which the machine performs its copying operation with copying papers which are to have an image affixed thereto are automatically fed one at a time from a paper supply unit and a manual feed mode in which the machine performs its copying operation with copying papers which are to have an image affixed thereto and which are fed manually one at a time.

In general, a present-day electrophotographic copying machine is so designed that, if the operator of the machine presets a counter the number of copies which are to be made, the copying operation can be repeated in succession for a number of cycles equal to the number of copies which are to be made. At this time, the contents of the counter are displayed by a digital display unit utilizing either light emitting diodes or liquid-crystal display elements to show the number of copies being made. The method for displaying or counting the copies being made is generally based on a count-down or count-up system such as disclosed in U.S. Pat. No. 4,105,914. Some copying machines employ either a display unit capable of showing a preset number of copies to be made or a counter for counting the number of copies being made in combination with a count-down counter or a count-up counter, examples of which are disclosed in U.S. Pat. No. 4,202,622 and Japanese Laid-open Patent Publication Nos. 53-125838 and 53-127729, both being laid open to public inspection in 1978.

For enabling an image to be copied on each side of a copying paper and/or enabling a special paper to be utilizable in reproduction of an image, some conventional copying machines have a manual paper feed unit which is provided separately from an automatic paper feed unit so that the machine can be set to operate with the copying papers which are to have an image affixed thereto are manually fed from the manual paper feed unit during one period of time and with the copying papers which are to have an image affixed thereto are automatically fed from the automatic paper feed unit during another period of time.

One form of the manual paper feed unit comprises a manual feed table supported by a machine housing for pivotal movement between a closed and an opened position such that, when the table is held in the open position, the machine can be automatically set to operate under a sequence control mode with the copying paper being manually fed through the table and, at the same time, the machine can be held in condition which is ready to receive the copying papers which are manually fed one at a time. An example of this is disclosed in the U.S. Pat. No. 4,204,668.

Another form of the manual paper feed unit comprises, such as described in connection with a preferred embodiment of the present invention, a removable feed table having a signal generating element such as a magnet or an actuating projection, which removable feed table can be removably inserted or loaded in a paper supply unit so designed as to accommodate a paper cassette containing a stack of copying papers. In this construction, when the removable feed table is loaded in the machine in place of the paper cassette, the signal generating element thereby actuates a switch element to set the machine in a condition which is ready to operate with copying papers being manually fed through the removable feed table.

In any event, any one of the conventional copying machine is so designed that when the automatic paper feed unit is in operation, a counter counts the number of copies being made, and the display unit displays the number of copies actually made or left unfinished on the basis of a result of the counting operation of the counter. No conventional copying machine, even though it has a capability of accommodating copying papers which are manually supplied one at a time in addition to the capability of accommodating the paper cassette containing a stack of copying papers, has yet been provided with a means for displaying the number of copies made on the manually supplied copying papers, and accordingly, the operator of the machine has long been formed to encounter with such an inconvenience as to manually count and remember the number of copies made. This is particularly true where a number of copies, each having its opposite faces bearing respective images, are made in succession using either ordinary copying papers or special papers.

SUMMARY OF THE INVENTION

Accordingly, the present invention has been developed with a view to substantially eliminating the above described disadvantages and inconveniences and has for its essential object to provide a counter control device for an electrophotographic copying machine, which can display the number of copies made, even when the machine performs its copying operation in a manual feed mode with copying papers which are manually supplied one at a time, without utilizing any other display unit.

Another important object of the present invention is to provide a counter control device of the type referred to above which does not require the user of the machine to pay attention to the number of copies displayed during the course of making such copies with the machine.

A further object of the present invention is to provide a counter control device of the type referred to above which can be manufactured with a minimized number of parts and, therefore, does not unreasonably increase the manufacturing cost of the machine.

To this end, a counter control device according to the present invention comprises a counter means for adding or subtracting "1" each time one cycle of copying operation in the multi-copy mode is completed and for displaying the number of copies actually made or the number of copies left unfinished; a display means for displaying count contents of the counter means; a means for storing the count contents of the counter means; a means for determining whether the machine is switched over to the multi-copy mode or the manual feed mode; a display control means for causing the display means to display "0" when the determining means determines that the machine is switched over to the manual feed mode and for adding "1" to the figure display by the display means each time one cycle of copying operation in the manual feed mode is completed; and means for retrieving the count contents stored in the storing means and causing the display unit to display the thus retrieved count contents when said machine is switched over from the manual feed mode to the multi-copy mode.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE INVENTION

Figure 1:
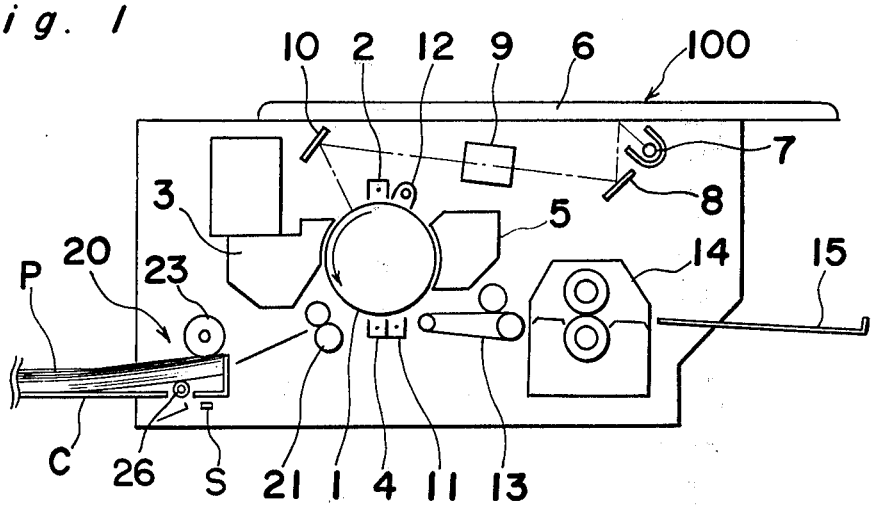
FIG. 1 is a schematic side view of an electrophotographic copying machine showing an arrangement of various components thereof inside a machine housing.

Before the description of the present invention proceeds, it is to be noted that like parts are designated by like reference numerals throughout the accompanying drawings.

Referring first to FIG. 1, an electrophotographic copying machine, generally identified by 100, comprises a photoreceptor drum 1 of any known construction supported inside a machine housing for rotation in one direction, around which drum 1 are arranged an electrostatic charger 2, a developer unit 3, a transfer charger 4 and a cleaner unit 5. This machine 100 is so designed that, an image of an original (not shown) placed on an original support 6 is scanned by an illuminating lamp 7 while the original support 6 is moved from a start position towards a scanned position relative to the lamp 7; rays of light, which have been reflected from the original on the original support 6 and, therefore, carry the image of the original, are projected onto the photoreceptor drum 1 by means of a first reflective mirror 8, and then a lens assembly 9, and finally a second reflective mirror 10. As the image of the original is so projected onto the photoreceptor drum 1 while the latter is rotated in one direction, an electrostatic latent image complemental in shape to the image of the original is formed on the photoreceptor drum 1, which latent image is subsequently developed into a visible powder image by the developer unit 3.

A plurality of copying papers P, which are stacked in a cassette C which is in turn placed on a paper supply unit C, are successively fed one at a time in synchronism with the rotation of the photoreceptor drum 1 towards a transfer station at which the powder image on the photoreceptor drum 1 is transferred onto the copying paper by the action of the transfer charger 4. The copying paper bearing the transferred powder image is separated from the photoreceptor drum 1 by the action of a charge eraser 11 and is then passed by means of a transport belt 13 through a fixing device 14, whereat the powder image on the copying paper is fixed by the application of heat. The copying paper having the fixed powder image thereon is finally ejected onto a storage tray 15.

On the other hand, during the continued rotation of the drum 1 and subsequent to the separation of the copying paper from the drum 1, a residue powder on the drum 1 is removed by the cleaner unit 5 and a residue electrostatic charge on the drum 1 is then removed by an eraser lamp 12 in readiness for the next succeeding cycle of copying operation.

Figure 2:
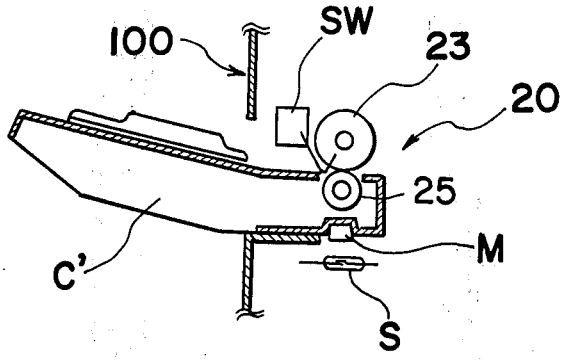
FIG. 2 is a side sectional view, on an enlarged scale, showing a manual paper supply unit employed in the machine of FIG. 1.

In the copying machine of the construction described, the copying papers in the cassette C which is placed on the supply unit are upwardly shifted by a lifting member 26 to contact a paper feed roller 23 which is adapted to be driven by a suitable paper feed signal synchronized with the above described copying operation to feed the copying papers one at a time from the cassette C towards the transfer station through a timing roller assembly 21. The timing roller assembly 21 serves to bring the copying paper to a halt temporalily until a synchronizing signal which is generated incident to the movement of the original support 6 is applied to drive the timing roller assembly 21 in synchronism with the rotation of the drum 1.

Where a manual paper feed is desired, the cassette C shown in FIG. 1 is removed and a manual feed table C′ is loaded, as shown in FIG. 2. Since the manual feed table C′ carries a permanent magnet M secured thereto, the loading of the table C′ in the manner as shown in FIG. 2 results in closure of a reed switch S to set the machine in a copying mode with manual paper feed, that is, to set the machine so as to be ready to perform its copying operation with copying papers manually supplied one at a time through the table C′. Specifically, in the copying mode with a manual paper feed, as a copying paper is inserted manually through the table C′ towards the paper feed roller 23, a switch SW is actuated in contact with the leading end of the copying paper being manually inserted to drive the paper feed roller 23, whereby the manually inserted copying paper is thereafter fed towards the transfer station through the timing roller assembly 21. The manual feed table C′ has a pinch roller 25 rotatably carried thereby, said pinch roller 25 being so positioned as to engage the feed roller 23 when and after the manual feed table C′ has been loaded in the manner as shown in FIG. 2. Alternatively, independently of the paper supply unit 20, the manual feed table C′ may be mounted on the machine housing for pivotal movement between closed and opened positions, such as disclosed in the aforementioned U.S. Pat. No. 4,204,668, so that, when the table is in the opened position, the copying paper can be manually inserted while disabling the paper supply unit 20. In addition, whichever method is employed, a combination of an actuating projection and a microswitch adapted to be actuated thereby may be employed in place of the combination of the magnet M and the reed switch S.

Figure 3:
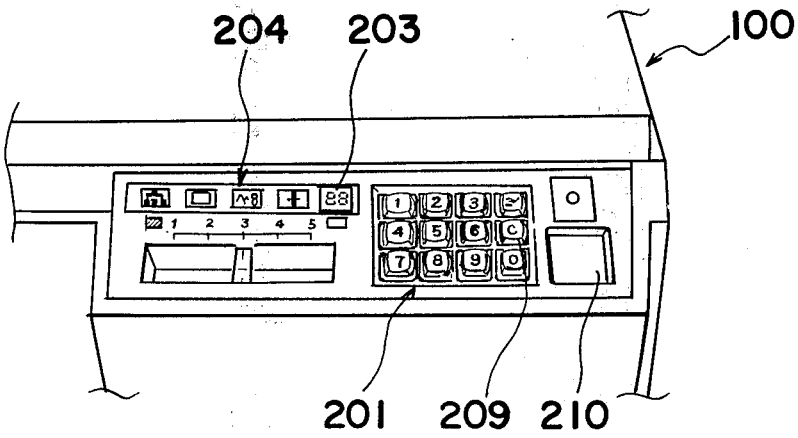
FIG. 3 is a perspective view of a portion of the machine, showing a layout of various input controls.
Figure 4:
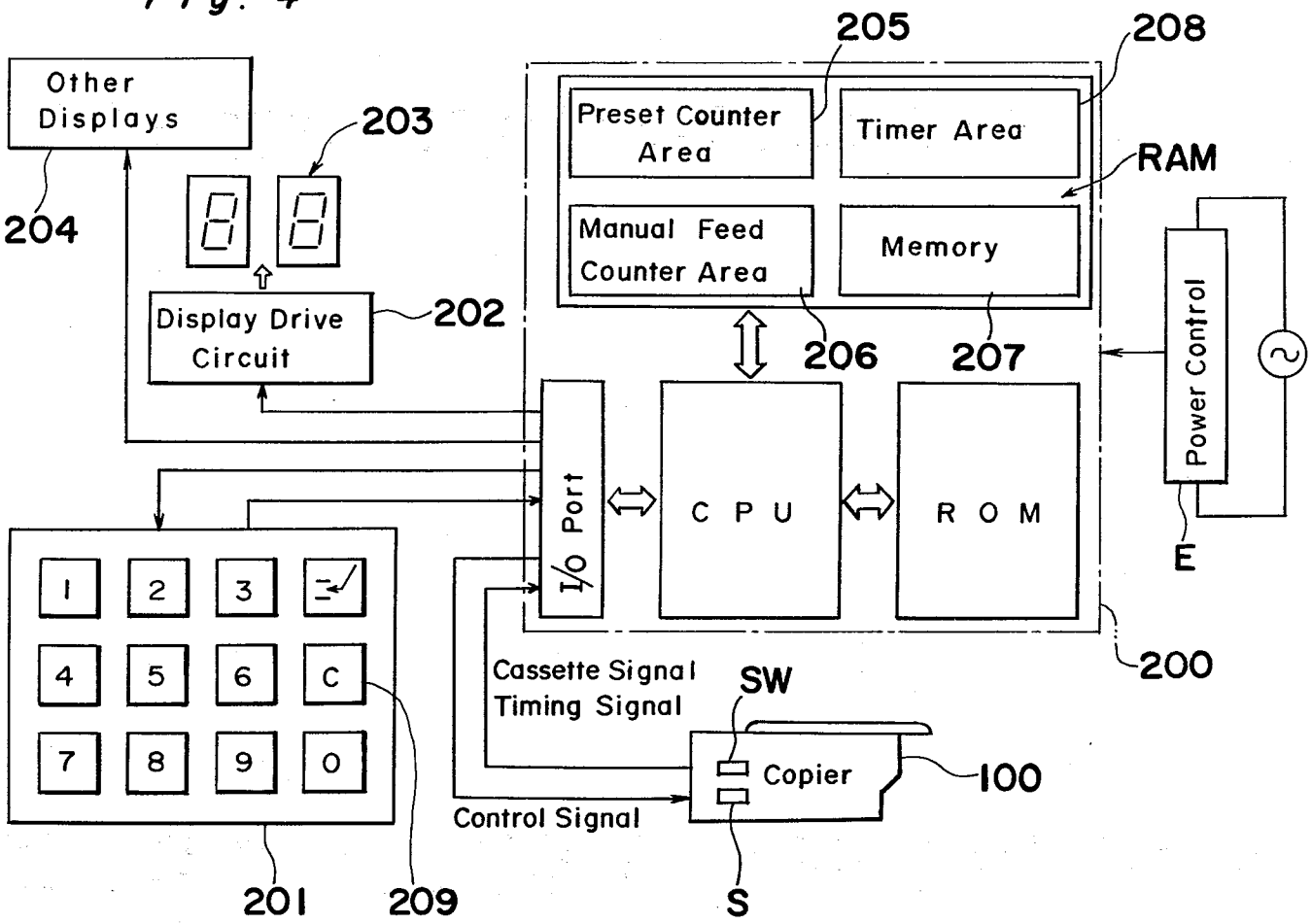
FIG. 4 is a schematic, circuit block diagram showing a computer control scheme.

Referring to FIGS. 3 and 4, the machine 100 has a control device 200 which comprises an electronic circuit including a micro-computer and its associated components, a basic construction of which includes an input-output control unit I/O, a central processing unit CPU, a read-only memory ROM and a random access memory RAM. The control device 200 is so designed as to receive various input signals fed from the copying machine 100 through the input-output control unit I/O, such input signals including signals indicative of operating conditions of the various components of the machine 100 and a mode switching signal indicative at the setting of the machine in the copying mode with manual paper feed which mode is hereinafter referred to as a manual feed mode, and also as to generate various control signals necessary to control the operation of the components of the machine, such control signals including the above described paper feed signal and a timing signal necessary to drive the timing roller assembly 21. It is to be noted that, since the control of the copying machine utilizing the micro-computer is disclosed in various literature, such as U.S. Pat. Nos. 4,033,692 and 4,054,380, the details thereof will not be described for the sake of brevity. It is also to be noted that a counter utilizing a micro-computer is also well known in the art and, therefore, the counter used in the present invention will be described according to an application manual of the commercially available model "μCOM43" sold by NIPPON ELECTRIC CO., LTD. of Japan.

During a mode of operation of the copying machine other than the manual feed mode, and where a multiple of copies are desired to be reproduced from the same master, the number of copies which are to be made is entered by manipulating some digit keys on an keyboard 201 to cause the control device 200 to apply to a display drive circuit 202 an output signal which is indicative of the number of the copies to be made from the same master; the drive circuit 202 subsequently drives a display unit 203 to present visual information as to the number of the copies to be made. At this time, the number of the copies to be made which has been entered through the keyboard 201 is set in a count area 205 of the random access memory RAM in the control device 200. When a "Print" switch 210 is manipulated to initiate a copying operation, the photoreceptor drum 1, the original support 6, the illuminating lamp 7 and other elements are brought into operation and the paper feed roller 23 is driven so as to automatically feed a copying paper P from the cassette C and, as a result thereof, the copying machine 100 generates an count signal indicative of each cycle of the copying operation. This count signal may be in the form of a signal synchronized with a signal for the sequence control and is fed to the control device 200 so that the preset count of a counter 205 provided in the random access memory RAM is reduced by "1" each time the copying operation is completed. A signal indicative of the contents stored in the count area 205 of the random access memory RAM is then fed from the control device 200 to the drive circuit 202 to cause the display unit 203 to display the number which has been reduced by "1". This type of counting operation is carried out according to a count-down program stored in the read-only memory of the control device 200. When the number stored in the count area 205 subsequently become "0" as a result of completion of the repetitive cycles of copying operations, the further cycle of a copying operation is interrupted and, thus, the copying operation to produce the desired number of copies is completed. In order to interrupt the continued copying operation at the time the number stored in the count area 205 becomes "0", not only is a predetermined flag changed from "1" to "0" according to a program, but also the contents of both the count area 205 and the display unit 203 are reset to either the desired number of copies initially stored in a memory 207 or "1".

It is to be noted that, in FIG. 4, reference character E represents a power control circuit for the control device 200, and reference numeral 204 represents a display unit for displaying information other than the number of copies to be made, such as the occurrence of a paper jamming in the machine 100 and/or the empty condition of one or both toners and copying papers. It is also to be noted that the display unit 203 is composed of, for example, a plurality of two seven-segment display elements of any known construction, the method for controlling the device circuit 202 for the display unit 203 by the use of the micro-computer being described in the aformentioned application manual for "μCOM43".

Figure 5:
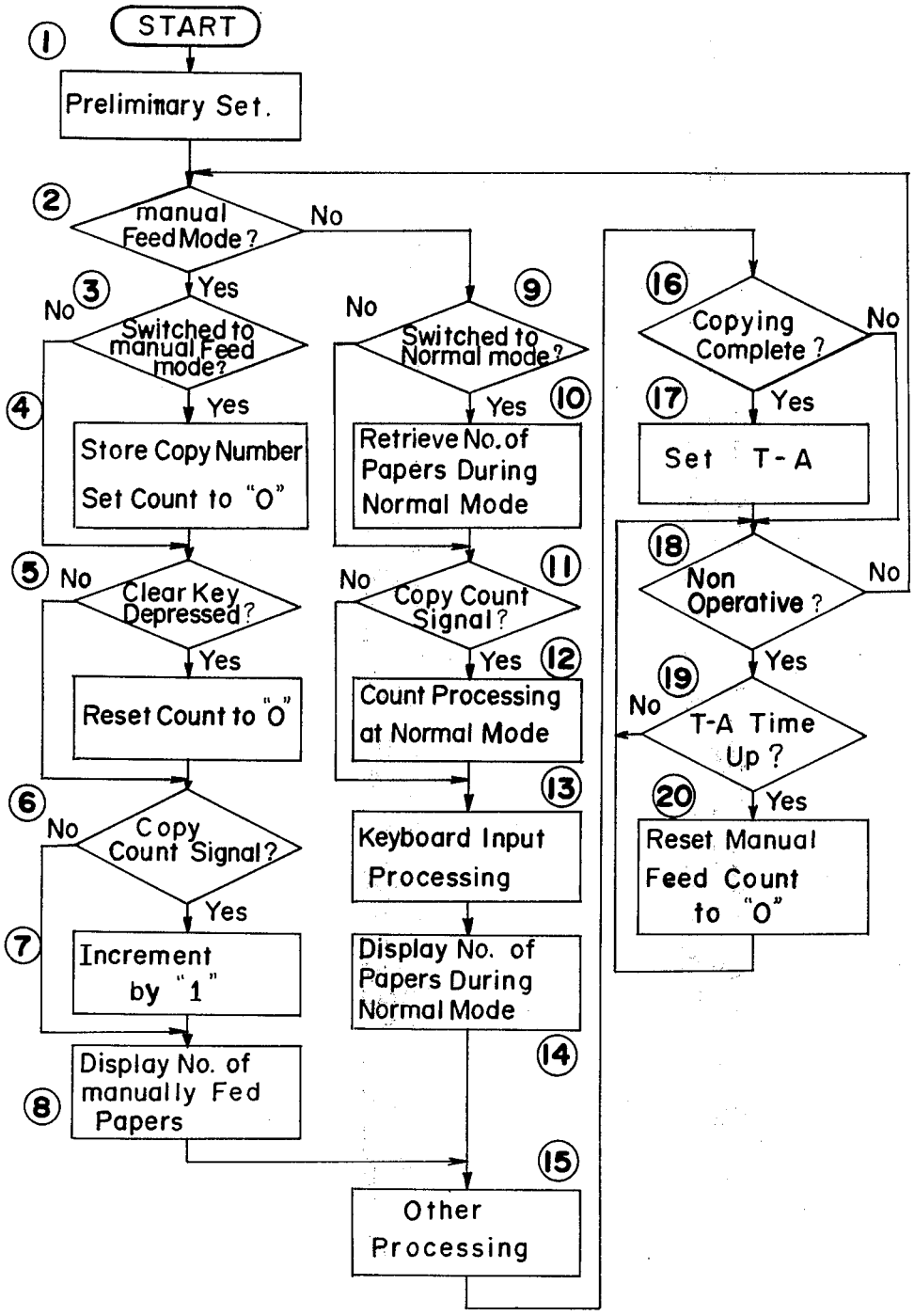
FIG. 5 is a flow chart showing a sequence of control performed by a microcomputer.

The above described control performed by the control device 200 during the manual feed mode and also during a multi-copy mode in which a desired number of copies can be made from the same master will now be described with reference to a flow chart shown in FIG. 5.

Let it be assumed that the machine 100 is supplied with electric power and, accordingly, the power control circuit E and the micro-computer are brought into operation. Referring to FIG. 5, at the step ①, a preliminary setting operation for standard mode setting is carried out when the desired number of copies to be made is not entered by an operator of the machine 100, so that the display unit 203 can automatically display "1". At the subsequent step ②, a check is made as to whether the machine 100 is set to operate in the manual feed mode and, if it is found to be in the manual feed mode, step ③ is followed by step ④ at which time a check is made as to whether the switching over to the manual feed mode has been completed, that is, whether or not a mode change signal generated from the reed switch S in cooperation with the magnet M carried by the manual feed table C' has been supplied to the control device 200.

If it is found at step ④ that the switching to the manual feed mode has been completed, the contents of the counter 205 during a normal mode in which the machine 100 is set to operate with copying papers automatically fed one at a time from the cassette C are stored in a predetermined area 207 of the random access memory RAM and, at the same time, a counter 206 for counting the number of copies to be made, which is provided in the random access memory RAM, is cleared after having been associated with the drive circuit 202, thereby causing the display unit 203 to display "0". In other words, when, for example, the machine 100 is set to operate in the manual feed mode after it has been operated in the multi-copy mode with the copying papers automatically fed one at a time from the cassette C, the number of copies left unfinished is stored and, at the same time, "0" is displayed by the display unit 203.

At step ⑤, a check is made as to whether a clear key 209 has been depressed. If the clear key 209 has been found to have been depressed, the contents of the counter 206 during the manual feed mode is cleared so as to display "0" by means of the display unit 203.

At steps ⑥ and ⑦, when the copying operation is performed in the manual feed mode, the contents of the counter 206 is incremented by "1" in response to a count signal fed from the machine. At step 8, the contents of the counter 206 are outputted.

Steps ② to ⑧ represent a process in which control operation takes place for displaying the number of copies during the manual feed mode. According to this process, when and after the machine 100 has been set to operate in the manual feed mode, not only are the contents of the counter 205 in the normal mode stored, but also the same display unit 203 displays "0" and the number displayed by the display unit 203 is incremented by "1" each time one copy is reproduced. Accordingly, the operator of the machine suffers substantially no inconvenience in counting the number of copies being made by the machine during the manual feed mode.

During the copying operation in the normal mode, step (2) is followed by the step (9) and, at step (10), the content of the counter 205 which have been previously stored are retrieved, thereby associating the counter 205 with the drive circuit 202. At steps (11) and (12), the counting of the number of copies being made during the normal mode is performed in such a way that the contents of the counter 205 is reduced by "1" in response to a count signal indicative of the completion of the reproduction of one copy out of the desired number of the copies to be made. At step (13), a process is performed in such a way that an output signal generated from the keyboard 201 by manipulating some of the digit keys during the normal mode is set in the count area 205 of the random access memory RAM. At step (14), the numerical data stored in the count area 205 of the random access memory RAM is outputted to the display unit 203. Step (15) is one in which processes other than the display of the number of copies, for example, copy density adjustment, display of the paper size and display of the selected magnification, are carried out. At step (16), a check is made as to whether the machine has completed its copying operation. This can be achieved by utilizing either a signal generated each time the original support 6 has returned to the start position after having been moved to the scanned position or a timer provided in the control device 200 for controlling the sequence.

If it is found that the copying operation has been completed, step (16) is followed by step (17) during which a timer T-A is set. This timer T-A is a digital timer provided in a timer area 208 of the random access memory RAM and being so designed that the preset time thereof can be incremented by "1" every one routine (for example, about 10 msec.) by the program. This timer T-A is so controlled by the program that, when the value counted by the timer T-A coincides with the predetermined numerical data, the timer T-A can generate a time-up signal.

At step (18), after the setting of the timer T-A, a check is made as to whether the machine 100 is newly operated under the manual feed mode and, if it is found that the machine 100 is operating under the manual feed mode, the operation of the timer T-A is substantially cancelled. When the machine 100 is allowed to stand subsequent to the completion of the copying operation under the manual feed mode, and if it is found at step (19) that the preset time of the timer T-A has elapsed, the contents of the counter is reset to "0" during step (20). More specifically, when about 60 seconds have passed subsequent to the completion of the copying operation under the manual feed mode without any other manipulation being performed within such a period of time, the counter 206 is reset to "0".

It is to be noted that, in the above described control, the count signal referred to may be a signal generated each time the original support 6 complete its scanning movement or, in the case of a copying machine of a type utilizing a movable optical scanning system in combination with a stationary original support, a signal generated each time the optical scanning system completes its scanning movement. Alternatively, the count signal may be the one generated each time the original support 6 returns to the start position after having been moved to the scanned position or a signal for controlling the sequence.

The counter 205 provided in the random access memory RAM may be adapted to be set by any device provided in the micro-computer, and the counters 205 and 206 may be provided in a common area in the random access memory RAM.

In the foregoing description, it has been described that the number of copies to be made which is displayed by the display unit 203 is reduced by "1" each time one copy has been made under the normal mode. However, it is also possible to employ a count-up system wherein the display unit 203 displays the number of copies actually made or to employ two separate display units, one for the display of the desired number of copies to be made and the other for the display of the number of copies actually made.

While the present invention is constructed such as hereinbefore fully described, it has now become clear that the operator of the copying machine need not ascertain the number of copies actually made each time one cycle of copying operation to produce one copy is completed. Therefore, the copying machine utilizing the counter control system according to the present invention is easy to handle, minimizing the labor and time required of the operator.

Moreover, since the contents of the counter stored during the normal mode are stored and, at the same time, the display unit is set to display a figure "0" even when the mode is switched over to the manual feed mode, the counting of the number of copies being made is initiated immediately when the machine is operated under the manual feed mode, without the operator forced to follow a special, extra procedure.

Furthermore, since a clear means is provided for resetting the counter for the manual feed mode to "0", the clear means exhibits its advantage when a plurality of copies are made in repetitive succession.

Although the present invention has been described in connection with the preferred embodiment thereof with reference to the accompanying drawings, it is to be noted that various changes and modifications are apparent to those skilled in the art. Such changes and modifications are to be understood as included within the true scope of the present invention unless they depart therefrom.

We claim:

1. In an electrophotographic copying machine comprising a preset counter device and which is selectively operable in one of a multi-copy mode wherein a copying operation is repeated to produce a plurality of copies while copying papers which are to have an image affixed thereto are automatically fed one at a time and a manual feed mode wherein said copying operation is carried out by the use of copying papers which are to have an image affixed thereto and which are fed manually one at a time, a counter control device which comprises:

a counter means for adding or subtracting "1" each time one cycle of copying operation in the multi-copy mode is completed for displaying one of either the number of copies actually made or the number of copies left unfinished;

a display means for displaying count contents of said counter means;

a means for storing said count contents of said counter means;

a means for determining whether the machine is switched over to said multi-copy mode or said manual feed mode;

a display control means for causing said display means to display "0" and for transferring said count contents of said counter means to said storing means when said determining means determines that the machine is switched over to said manual feed mode and for adding "1" to the figure displayed by said display means each time one cycle of copying operation in said manual feed mode is completed; and a means for retrieving said count contents stored in said storing means, and for causing said display means to display the thus retrieved count contents when said machine is switched over from said manual feed mode to said multi-copy mode.

2. A device as claimed in claim 1, further comprising a timer means which is operable when said machine is in said manual feed mode for detecting the length of time during which the copying operation in said manual feed mode is interrupted, and further comprising an auto-clear means for automatically resetting the figure displayed by said display means to "0" upon the lapse of a preset time of the timer means.

3. A device as claimed in claim 1, further comprising a manipulatable clear means which is operable during said manual feed mode for resetting the figure displayed by said display means to "0".

4. A device as claimed in claim 1, wherein said counter means and said display control means comprise a micro-computer, said counting operation being performed according to a program stored therein.

5. A device as claimed in claim 1, wherein said counter means performs said counting operation to subtract "1" from a predetermined preset value each time one cycle of copying operation is completed and wherein said display control means performs its counting operation to add "1" to said preset value each time one cycle of copying operation is completed.

6. In an electrophotographic copying machine which is selectively operable in one of a multi-copy mode wherein a copying operation is repeated to produce a plurality of copies while copying papers which are to have an image affixed thereto are automatically fed one at a time and a manual feed mode wherein said copying operation is carried out by the use of copying papers which are to have an image affixed thereto and which are fed manually one at a time, a counter control device which comprises:

a counter means for performing a counting operation each time one cycle of copying operation in said multi-copy mode is completed;

a display means for displaying a numerical figure in association with count contents of said counter means;

a means for determining whether the machine is switched over the said multi-copy mode or said manual feed mode;

a display control means for clearing said display means when said determining means determines that the machine is switched over to said manual feed mode and for causing said display means to display a numerical figure corresponding to the number of copying papers which have been manually fed into the machine during said manual feed mode; and a means for clearing the figure displayed by said display means during said manual feed mode when said manual feed mode is cancelled and for displaying the contents of said counter means at the time in which said machine is switched over from said multi-copy mode to said manual feed mode.

7. A device as claimed in claim 6, wherein said display control means causes said display means to display "0" when the machine is set to operate in said manual feed mode.

8. A device as claimed in claim 6, further comprising a means for storing said count contents of the counter means, the switching over of the machine from said manual feed mode to said multi-copy mode resulting both in clearing of the numerical figure displayed during said manual feed mode and in displaying of a numerical figure corresponding to the contents of said counter means as stored in said storing means.

9. A device as claimed in claim 6, wherein said counter means and said display control means comprise a micro-computer, said counting operation being performed according to a program stored therein.

10. A device as claimed in claims 6 or 9, wherein said counter means performs said counting operation to subtract "1" from a predetermined preset value each time one cycle of copying operation is completed and wherein said display control means performs its counting operation to add "1" to said preset value each time one cycle of copying operation is completed.

11. A device as claimed in claim 6, further comprising a time means which is operable when said machine is in said manual feed mode for detecting the length of time during which the copying operation in said manual feed mode is interrupted, and further comprising an auto-clear means for automatically resetting the figure displayed by "said" display means to "0" upon the lapse of a preset time of the timer means.

12. A device as claimed in claim 6, further comprising a manipulatable clear means which is operable during said manual feed mode for resetting the figure displayed by said display means to "0".

* * * * *